US006725556B1

(12) United States Patent
Graham

(10) Patent No.: US 6,725,556 B1
(45) Date of Patent: Apr. 27, 2004

(54) RAFTER TOOL AND METHOD

(76) Inventor: Randal L. Graham, 320 Turnpike St., Beaver Falls, PA (US) 15010

( * ) Notice: Subject to any disclaimer, the term of this patent is extended or adjusted under 35 U.S.C. 154(b) by 0 days.

(21) Appl. No.: 10/256,926

(22) Filed: Sep. 28, 2002

(51) Int. Cl.[7] ..... B43L 7/027
(52) U.S. Cl. ..... 33/474; 33/429
(58) Field of Search ..... 33/429, 1 G, 413, 33/474, 476, 481, 482

(56) References Cited

U.S. PATENT DOCUMENTS

| | | | | | |
|---|---|---|---|---|---|
| 422,852 | A | | 3/1890 | Traut | |
| 496,714 | A | | 5/1893 | Allred | |
| 940,067 | A | | 11/1909 | Richter | |
| 1,173,789 | A | | 2/1916 | Fox | |
| 1,290,977 | A | | 1/1919 | Greene | |
| 1,686,441 | A | | 10/1928 | Dauger et al. | |
| 2,212,331 | A | | 8/1940 | Tracy | |
| 2,340,032 | A | | 1/1944 | Witter | |
| 2,744,332 | A | | 5/1956 | Day | |
| 3,350,784 | A | | 11/1967 | Schabel | |
| 4,380,872 | A | | 4/1983 | Moran | |
| 4,462,166 | A | | 7/1984 | Furlong | |
| 4,641,435 | A | | 2/1987 | Brown | |
| 4,742,619 | A | | 5/1988 | Swanson | |
| 4,773,163 | A | | 9/1988 | Wolford, Jr. | |
| 5,022,158 | A | * | 6/1991 | Beyer | 33/413 |
| 5,136,785 | A | | 8/1992 | Shirley | |
| 5,170,568 | A | | 12/1992 | Wright | |
| 5,359,782 | A | | 11/1994 | Langmaid | |
| 5,575,074 | A | | 11/1996 | Cottongim et al. | |
| 5,727,325 | A | * | 3/1998 | Mussell | 33/429 |
| 5,758,428 | A | | 6/1998 | Kotlinski | |
| 5,813,126 | A | * | 9/1998 | Dahl | 33/474 |
| 6,161,297 | A | | 12/2000 | Boggs | |
| 6,230,416 | B1 | * | 5/2001 | Trigilio | 33/474 |
| 6,293,028 | B1 | | 9/2001 | Sylvia | |
| 6,327,786 | B1 | * | 12/2001 | Felix | 33/474 |
| 6,374,504 | B1 | | 4/2002 | Graham | |
| 2003/0070310 | A1 | * | 4/2003 | Werner et al. | 33/474 |

FOREIGN PATENT DOCUMENTS

| | | |
|---|---|---|
| IT | 719758 | 11/1966 |

* cited by examiner

*Primary Examiner*—Christopher W. Fulton
(74) *Attorney, Agent, or Firm*—Aileen Champion Addessi

(57) ABSTRACT

A rafter tool and method includes a rafter square portion, a base portion, an extension member, an L-bar and a support bracket. The extension member, such as a string, may be wrapped within the base portion during storage of the rafter tool and can be extended between two points for laying out a rafter board. The square portion may be integrally attached to the base portion and is used for providing angular and distance measurements. The L-bar and support bracket can also be stored within the base portion and are used when laying out rafters. The method includes using a floor surface, a stud wall, or a building to lay out the rafter boards.

20 Claims, 11 Drawing Sheets

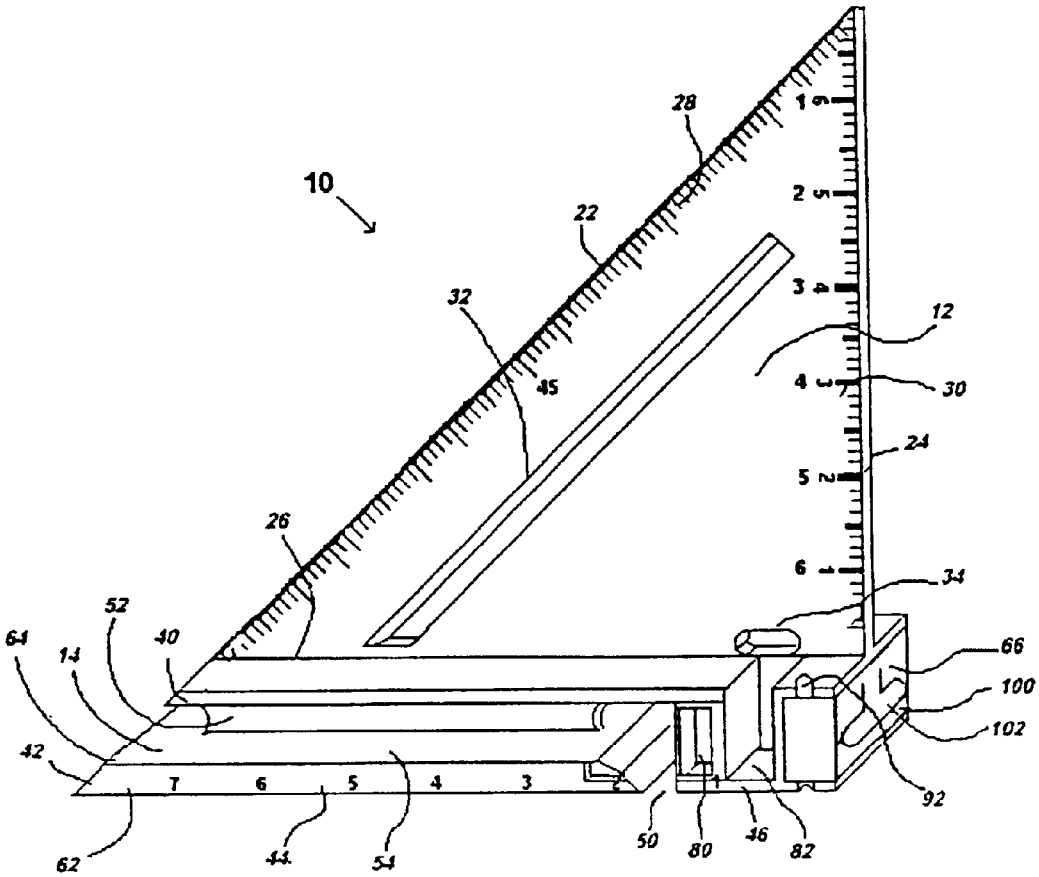
FIG.1
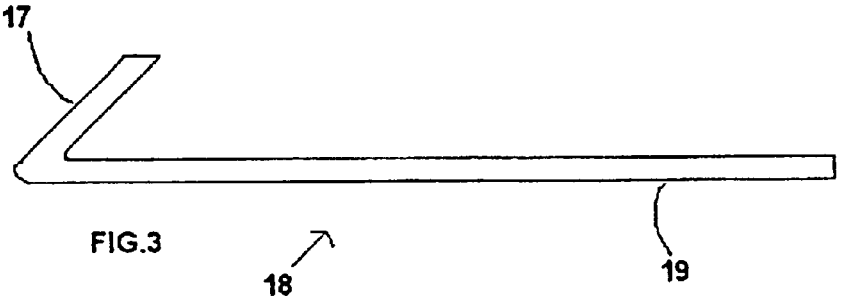
FIG.3
FIG.4
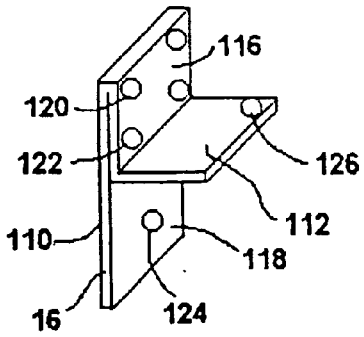

RAFTER TOOL AND METHOD

BACKGROUND OF THE INVENTION

The invention relates to roofing tools and, more particularly, to a tool and method for laying out boards for building rafters.

To lay out rafters for constructing a roof involves measuring and cutting boards for common rafters, valley rafters, hip rafters and jack rafters. Each rafter must be cut to the proper length with the correct angles and seat cut.

There are several kinds of tools which may be used to lay out rafters. One such device is a SPEED® square which includes graduated markings for determining angles and lengths. The SPEED® square is currently used in combination with a tape measure.

A rafter tool is disclosed in U.S. Pat. No. 2,744,332 entitled "Rafter Tool". The tool includes a main body having horizontal and vertical arms and a flexible rule. The tool is positioned on a plate member of a building and the flexible rule is pulled to the peak of the building. An aligning arm is clamped in position to define the rafter angle. The tool is then moved to a board and the clamped aligning arm is laid on the board to transfer the size of the angle onto the board. However, the tool does not include graduated markings for noting the degree of the angle when the tool is positioned on the building and the tape rule is cumbersome and difficult to maneuver.

U.S. Pat. No. 4,462,166 entitled "Device for Measuring Lengths and Conforming Angles" discloses a tool having telescoping members to measure the distance between the peak of the building and the wall of the building. However, the telescoping members are cumbersome and difficult for one person to maneuver.

U.S. Pat. No. 6,374,504 entitled "Rafter Tool and Method" discloses a rafter tool having a first support bracket which is attachable to a rafter square, a second support bracket, and a guide member for laying out rafter boards.

Therefore, what is needed is an apparatus and method for laying out rafters which includes, and compactly and conveniently stores, all of the necessary components for laying out rafters and which may be used for laying out rafters on a ground surface, on a stud wall, on the roof supports, or in any other convenient location.

SUMMARY OF THE INVENTION

A rafter tool includes a square portion having a first edge, a second edge and a third edge. The first edge has a degree scale and the second edge has a measuring scale. A base portion includes an upper support, a lower support, and a center support positioned therebetween. The upper support is attached to the third edge of the square portion. The base portion has a first slot positioned parallel to the center support and extending along the lower support and has at least one second slot positioned perpendicular to the center support and extending through the upper and lower supports. An extension member is positionable about the center support of the base portion during storage of the extension member and extendable from the base portion during use of the rafter tool. The extension member is alignable with the degree scale of the square portion for providing an angular measurement for a rafter board. An L-bar is positionable within the first slot during storage of the L-bar and positionable within the at least one second slot during use of the rafter tool. A support bracket has a first bracket portion, a second bracket portion positioned perpendicular thereto and a plurality of holes therethrough.

A method for laying out rafters includes the steps of measuring a run of a building and measuring a rise of a building, marking the measured run and rise of the building on a first surface, positioning a support bracket in a first position determined by one of the measured run or rise of the building, positioning the rafter tool in a second position determined by the other of the measured run or rise of the building, extending an extension member from the support bracket to the rafter tool, reading an angle on the rafter tool which aligns with the extension member, removing the support bracket and rafter tool from the first and second positions, positioning the support bracket on one edge of the board, adjusting an L-bar attached to the rafter tool to a heel cut depth, sliding the L-bar along the edge of the board until the extension member lines up with the angle read on the rafter tool, marking the board along an edge of the rafter tool for laying out a first cut on the board, measuring a length of the seat cut of the rafter board, and determining the degree of the heel cut and using that same degree for laying out a second cut on the board.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

FIG. 1 is a view of a rafter tool;

FIG. 3 is a view of an L-bar of the rafter tool;

FIG. 4 is a view of a support bracket of the rafter tool;

DESCRIPTION OF THE PREFERRED EMBODIMENT

Figure 2:
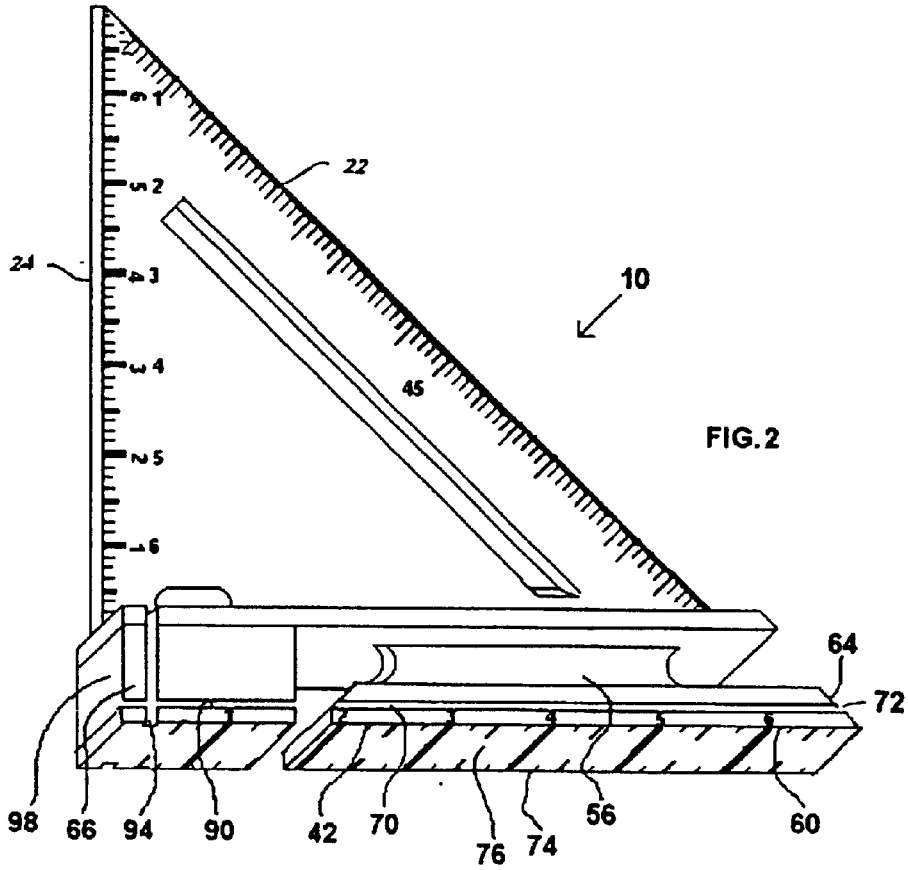
FIG. 2 is a view of an opposite side of the rafter tool.

Referring to FIGS. 1–5, a rafter tool 10 includes a square portion 12, a base portion 14, a support bracket 16, an L-bar 18 and an extension member or string 20. The square portion 12 includes a first edge 22, a second edge 24 and a third edge 26 forming a triangular member or rafter square, which is similar to a typical SPEED® square used for laying out rafters. A degree scale 28 is positioned along the first edge 22 and a measuring scale 30 is positioned along the second edge 24. The degree scale 28 includes numerical and graduated markings for providing angular measurements. The measuring scale 30 includes numerical and graduated markings, such as inch and fraction on inch increments for providing distance measurements. The square portion 12 also includes a hip and valley scale 32 disposed therethrough and positioned parallel to the first edge 22.

The square portion 12 includes a hole 34 for insertion of a pencil 36 during use of the pencil 36 while laying out rafters. The hole 34 is positioned adjacent to the third edge 26 near the right angle corner of the square portion 12.

The base portion 14 is positioned adjacent to the third edge 26 and attached thereto, such as integrally formed with the square portion 12, a separate piece and attached to the square portion 12, or the like.

The base portion 14 includes an upper support 40 positioned parallel to a lower support 42. The upper support 40 is positioned perpendicular to the third edge 26 for forming a T-shape. The lower support 42 provides a flat surface for positioning the rafter tool 10 on a roof, on a board, on the ground, or on any surface. The base portion 14 also includes a first end portion 44 and a second end portion 46 separated by a gap 50. The first end portion 44 includes a center support 52, which is positioned extending longitudinally between the upper and lower supports 40 and 42 and parallel to the third edge 26. Positioned adjacent to the center support 52 and on each side of the center support 52 is a first recess 54 and a second recess 56 for storage of the string 20.

The base portion 14 further includes a first side 60, a second side 62, a front edge 64 and a rear edge 66. The lower support 42 of the first end portion 44 further includes a slot 70 positioned parallel with the lower support 42 and on the first side 60 of the lower support 42. Alternatively, the slot 70 may have a first portion positioned parallel to the lower support 42 and a second portion 72 positioned perpendicular to the first portion and on the front edge 64 forming an L-shaped slot for storage of the L-bar 18.

The lower support 42 of the base portion 14 further includes an inch scale 74 on a bottom surface 76 of the base portion 14. The inch scale 74 may also extend along either the first side 60, the second side 62, or both sides of the lower support 42 for enabling a person to visually view the inch scale 74 while the rafter tool 10 is positioned resting on the bottom surface 76. The inch scale 74 may have numerical and graduated markings.

The second end portion 46 includes a first compartment 80 and a second compartment 82. The first compartment 80 has at least one opening for receiving and storing at least a portion of the string 20. Preferably, one of the openings faces either the first or second side 60 or 62 of the base portion 14 for enabling the string 20 to be conveniently placed within the first compartment 80. The second compartment 82 has at least one opening and is sized and positioned for housing the pencil 36. Preferably, one of the openings faces upwardly toward the square portion 12 for enabling the pencil 36 to extend upwardly along the square portion 12 during storage of the pencil 36.

The second end portion 46 includes a second slot 90 positioned parallel and aligned with the first slot 70 of the first end portion 44 for enabling the L-bar 18 to be slidably received within the slot 70 and within the second slot 90 during storage of the L-bar 18.

The second end portion 46 further includes a third slot 92 and a fourth slot 94. The third slot 92 is positioned on one of the first and second sides 60 and 62 of the base portion 14 and the fourth slot 94 is positioned on the other of the first and second sides 60 and 62 of the base portion 14. The third and fourth slots 92 and 94 are positioned perpendicular to and may intersect the slot 90. The third and fourth slots 92 and 94 are for slidably retaining the L-bar 18 during use of the L-bar 18 for laying out rafters. While inserted within the third and fourth slots 92 and 94, the L-bar 18 extends along the second edge 24 of the square portion 12 and may be positioned in various positions depending on the desired size and shape of the board.

The rear edge 66 of the base portion 14 may have a recessed area 98 for retaining a clip 100. The clip 100 has at least one catch 102 for wrapping the string 20 around. As an alternative to the use of a separate clip 100, the catch, hook or clasp 102 may be integrally formed with the base portion 14. An advantage of the use of a separately formed clip 100 is that if the catch 102 breaks off, then the broken clip 100 may be replaced with a new clip 100. The clip 100 snaps snugly onto the rear edge 88 of the base portion 14.

The L-bar 18 of the rafter tool 10 is an L-shaped bar or rod that is used during laying out of the rafter boards. Preferably, the L-bar 18 is formed of metal for providing a durable material, however, any suitable type of material may be used. The L-bar 18 is stored within the slot 70 in the base portion 14. The L-bar 18 has a first portion 19 and a second shorter portion 17 extending substantially perpendicular to one another.

The rafter tool 10 further includes the support bracket 16 having a first bracket portion 110 and a second bracket portion 112 positioned perpendicular to one another. The first bracket portion 110 has a first end 116, a second end 118 and a plurality of holes therethrough. The holes include at least one hole 120 for use when laying out the rafter boards and stair cases. Also, the first bracket portion 110 includes at least one hole 122 for attaching a hook 130 attached to the string 20 when measuring the rise. A hole 124 is for insertion of a screw to secure the support bracket 16 at the end of the rise and rafter board.

The second bracket portion 112 is positioned between the first end 116 and the second end 118 and has at least one hole 126. The support bracket 16 is T-shaped to compensate for the thickness of the base portion 14. The support bracket 16 may be stored attached to the square portion 12 by positioning the second bracket portion 112 of the support bracket 16 within the gap 50 and positioning the first bracket portion 110 between the upper support 40 and the lower support 42 of the base portion 14. The L-bar 18 may be disposed through the hole 126during storage for retaining the support bracket 16 against the square portion 12.

The rafter tool 10 further includes an extension member or the string 20, which is formed from a flexible material. The string 20 is positionable about the center support 52. An end of the string 20 is attached to the hook 130 for engagement with the hole 122 in the support bracket 16 during use of the support bracket 16. The hook 130 and end of the string 20 are positionable within the first compartment 80 during storage of the string 20. The string 20 may be extended between the support bracket 16 and the base portion 14 and is alignable with the degree scale 28 when laying out the rafter boards.

Figure 6:
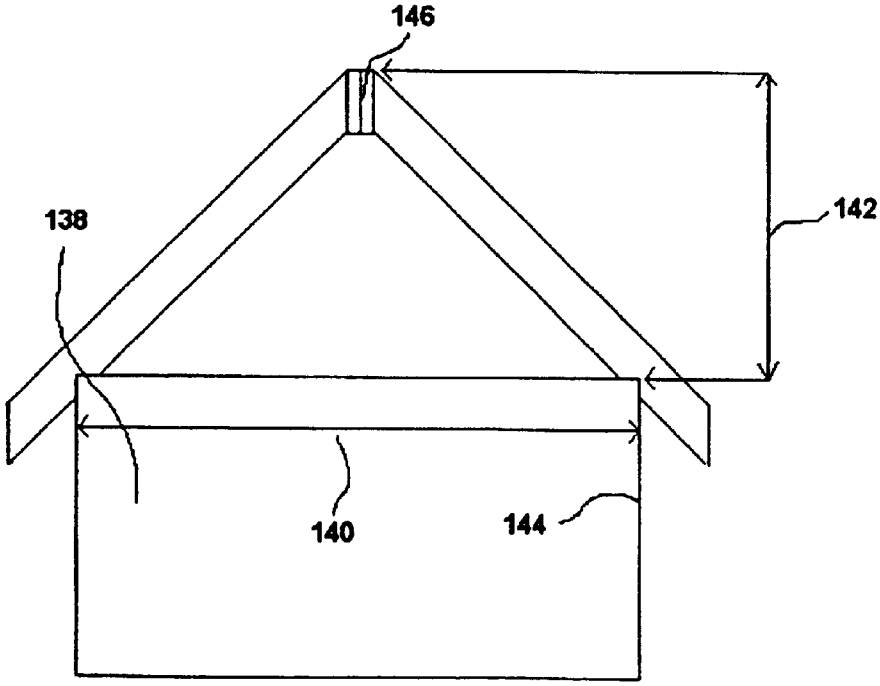
FIG. 6 is a view of a building with a ridge board.
Figure 5:
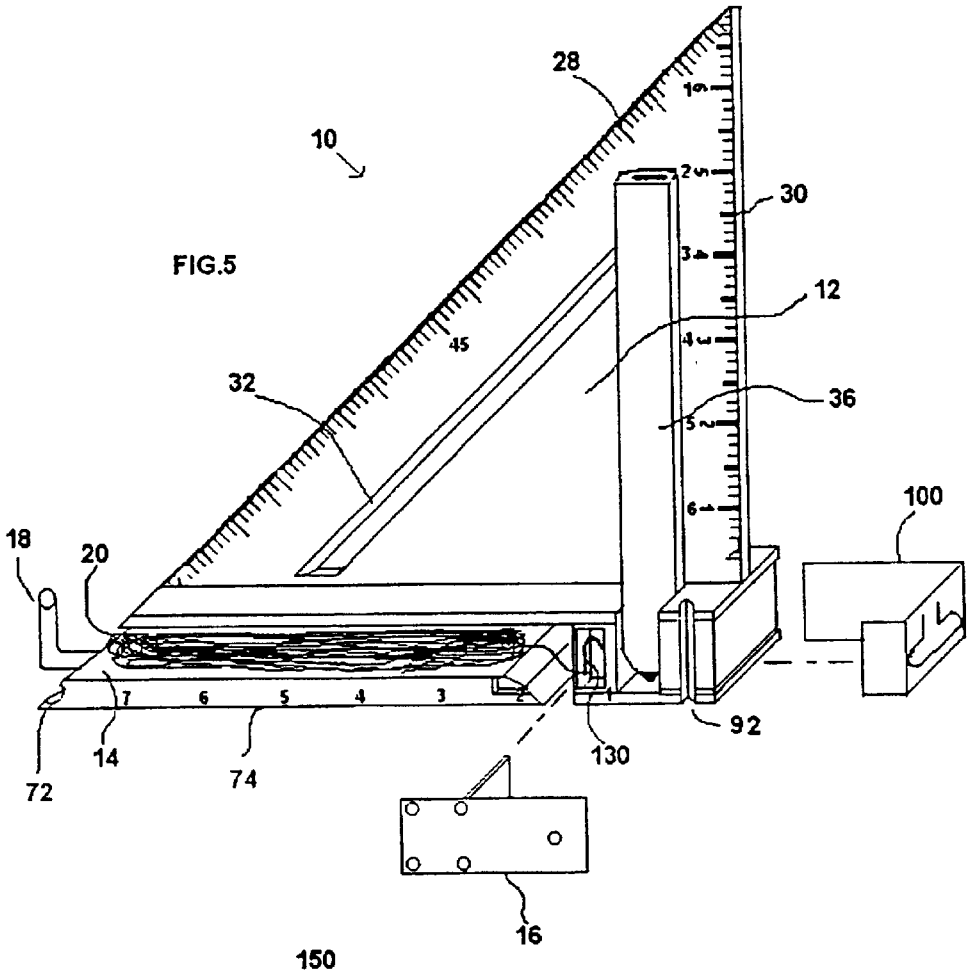
FIG. 5 is an exploded view of the components of the rafter tool.

In operation, referring to FIG. 6, to lay out a common rafter, measure the total run 140 of the building 138 and the total rise 142 from the top of the wall 144 to the ridge board 146. Divide the run in half, and if a ridge board is used, then deduct half the thickness of the ridge board from the run.

Figure 7:
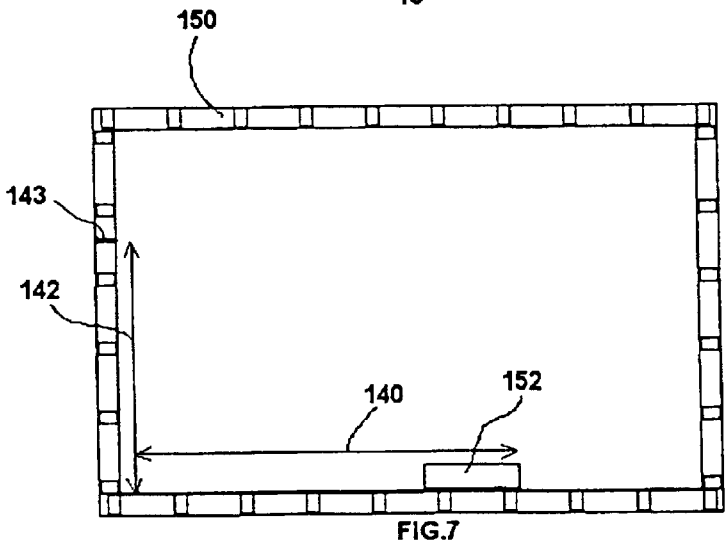
FIG. 7 is a view of a sub-floor.

Referring to FIG. 7, to lay out the rafter board 162 using the ground instead of the building 138 and ridge board, use the sub floor 150 and measure the run 140 and put a mark on the sub floor. Place a-scrap piece of wood 152 at the end of the run on the mark. Then, measure the width of the scrap wood and add that total to the rise. Measure the rise 142 and put a mark 143 on the sill plate. This method is the same as going from the wall 144 to the ridge 146.

Figure 8:
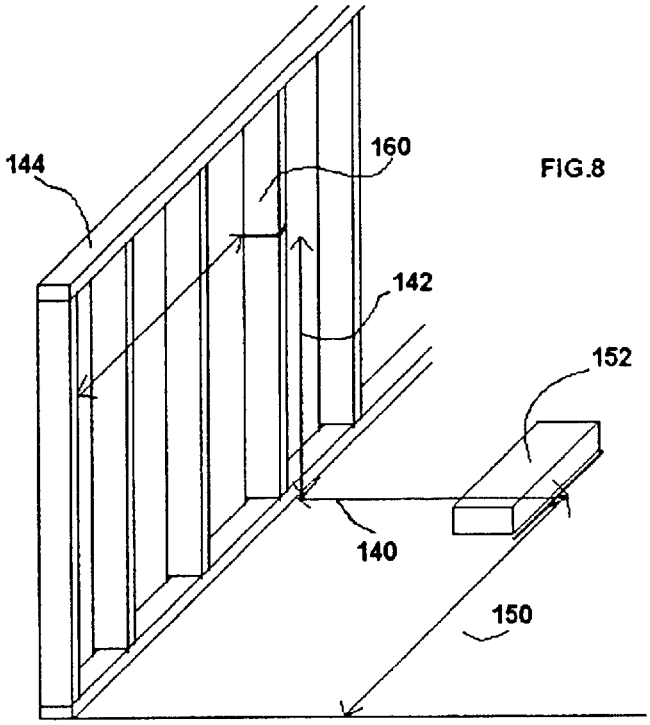
FIG. 8 is a view of a wall having studs.

Alternatively and referring to FIG. 8, if the wall 144 is high enough, find a stud 160 and measure the total run 140 back from the stud 160 along the floor and put a mark with a pencil. Put a scrap piece of wood there and secure it. Then, measure up the stud 160 the total rise 142 adding the thickness of the scrap piece of wood and put a mark on the stud. From that point, measure back to the inside of the wall 144. Then, measure the same distance on the sub floor 150 over to the scrap piece of wood 152 that will keep the string 20 in line.

Figure 9:
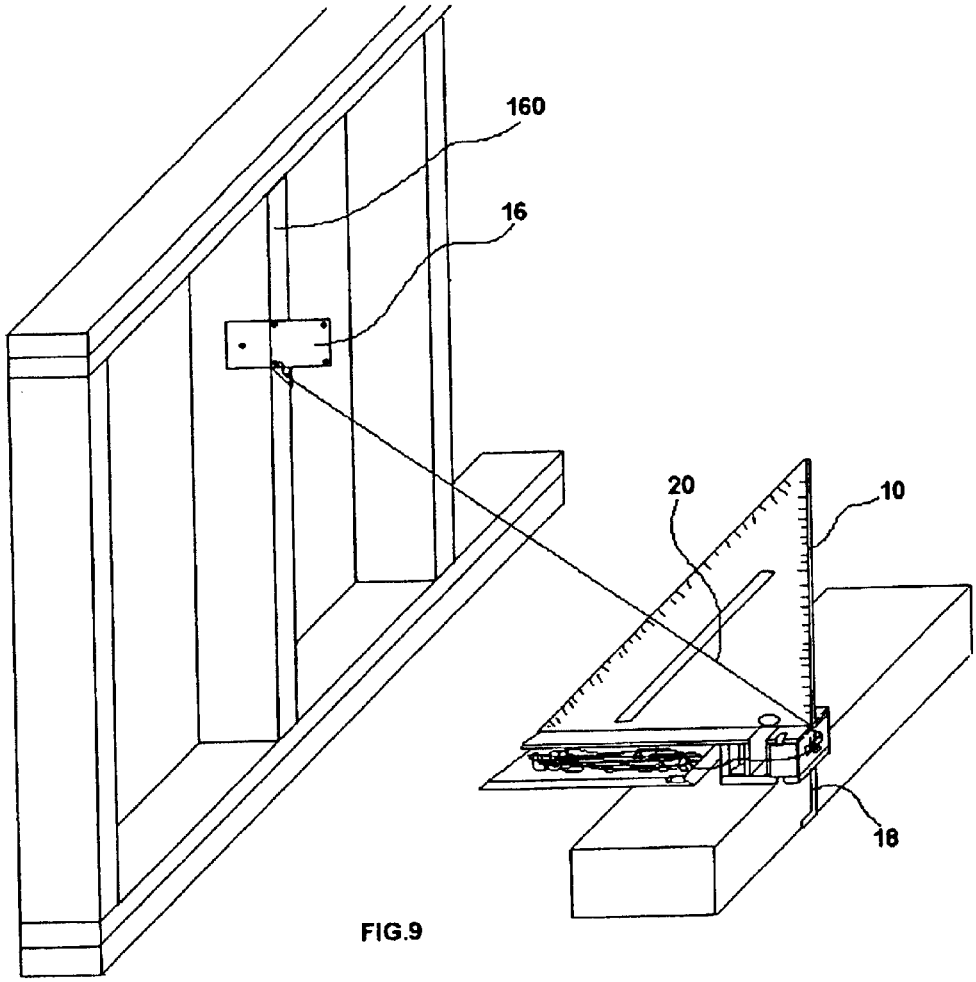
FIG. 9 is view of the rafter tool having a square portion positioned in a first position and the support bracket positioned in a second position.

Referring to FIG. 9, secure the support bracket 16 to either the stud 160 or the scrap piece of wood 152. Then, put the rafter tool 10 on the scrap piece of wood and pull the string taught, but not stretching the string 20. Secure the string 20 to hole 122 and write down the degree that the string 20 lines up with. The string 20 should be secured to the rafter tool 10 on one of the first and second sides 60 or 62 and the L-bar 18 should be disposed through one of the slots 92 or 94 on the opposite of the first and second sides 60 and 62 as the string 20. Also, keep the string 20 in line with the pencil mark.

Then, remove the support bracket 16, leaving the string 20 attached and adjust the L-bar 18 to the heel cut depth. On either side of the rafter tool 10, there are numbers on the measuring scale 30 that the L-bar 18 lines up with. These numbers may be used for laying out the desired heel cut.

Figure 12:
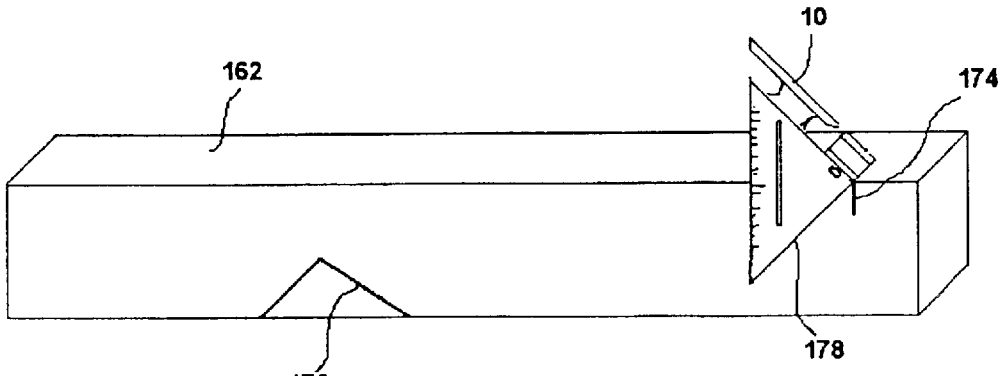
FIG. 12 is a view of the rafter tool positioned on a board for laying out a common rafter.
Figure 10:
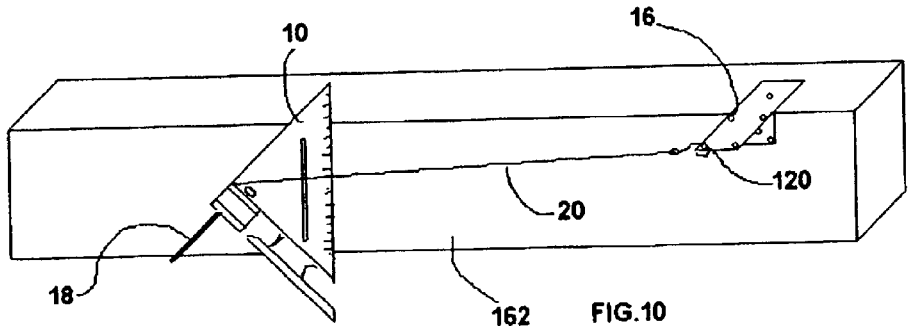
FIG. 10 is a view of the rafter tool positioned on a board for laying out a common rafter.
Figure 14:
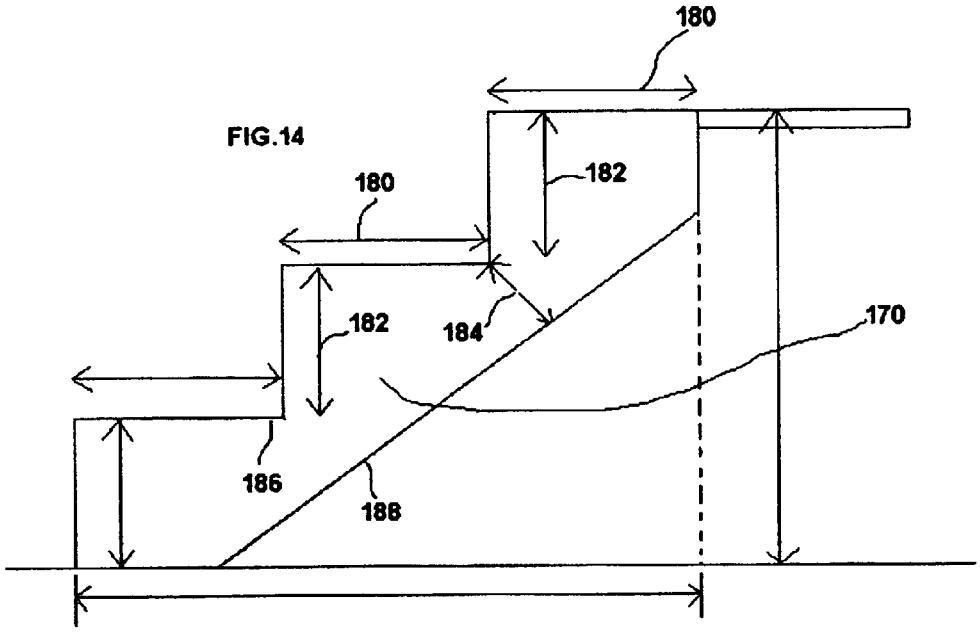
FIG. 14 is a view of a stair case laid out by the rafter tool.
Figure 11:
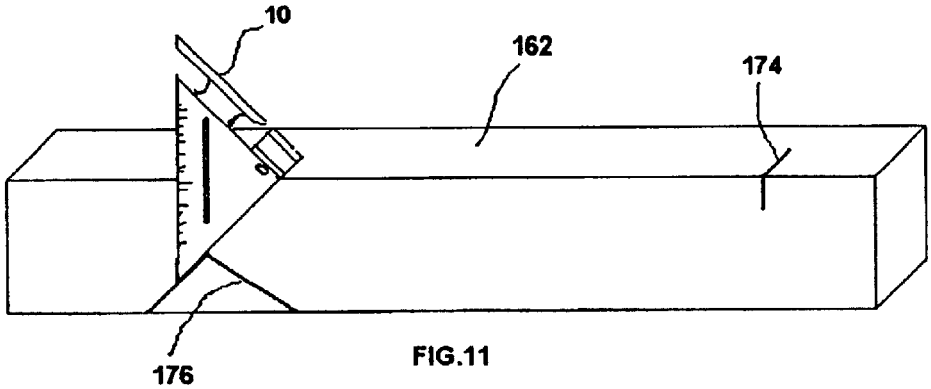
FIG. 11 is a view of the rafter tool positioned on a board for laying out a common rafter.

Referring to FIGS. 10, 11 and 12, secure the support bracket 16 to the rafter board 162 and put the string 20 in the hole 120. Mark the board with a pencil for making mark 174. Then, put the L-bar 18 over the edge of the board and line the string 20 up with the degree you had measured. Trace with a pencil the inside of the birds mouth cut 176. Using the inch scale 74, determine the seat cut length of the rafter board when on top of the wall of the building.

Figure 13:
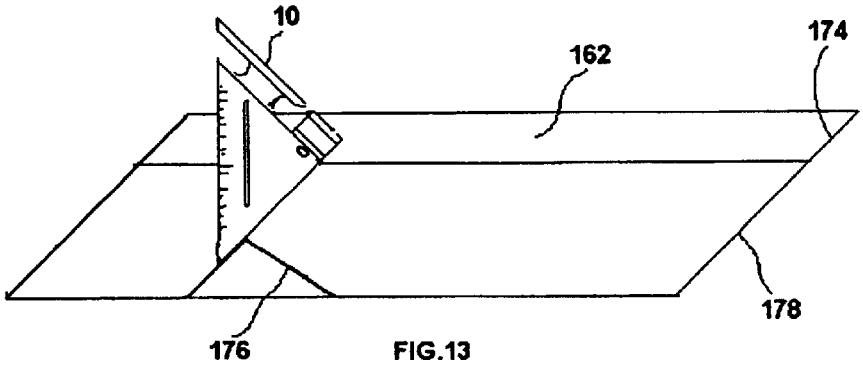
FIG. 13 is a view of the rafter tool positioned on a board for laying out a common rafter.
Figure 15:
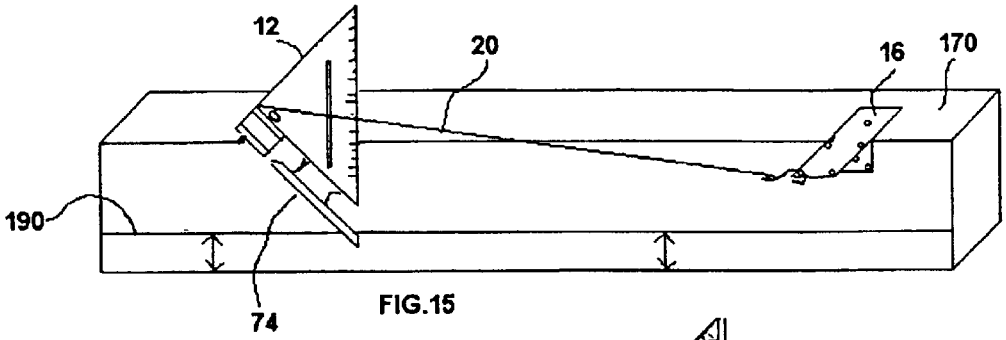
FIG. 15 is a view of the rafter tool positioned on a board for laying out the stair case.
Figure 16:
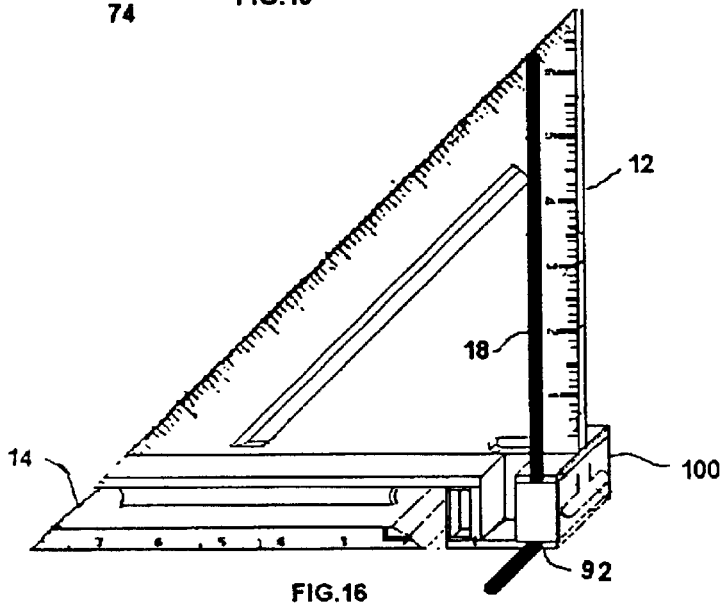
FIG. 16 is a view of the rafter tool with the L-bar.
Figure 17:
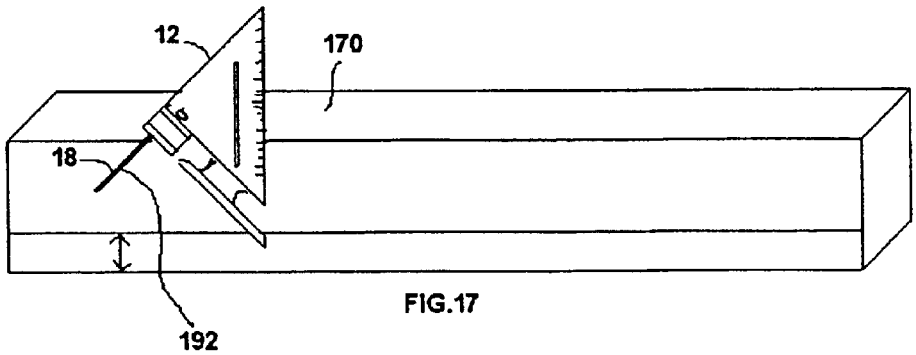
FIG. 17 is a view of the rafter tool positioned on the board for laying out the stair case.

Referring to FIGS. 12 and 13, wrap the string 20 onto the center support 52 and place the support bracket 16 and the L-bar 18 back into the base portion 14. Then, take the rafter tool 10 and transfer the degree of the heel cut to the support bracket 16 pencil mark 174 and make a mark 178 with the pencil. The board may be cut along the pencil markings. Using the hip and valley scale 32, put the square portion 12 in line with the heel and look at the common scale pitch number. This number will represent the pitch of the roof.

Referring to FIGS. 14–18, to lay out stair cases using the rafter tool 10, use the same procedure as when laying out a common rafter board. As an example, to lay out stairs having a 10" run 180 and a 6 ½" rise 182, there should be a minimum distance 184 of 4" from the end of the tread run 186 to the edge 188 of the board. The string 20 may be aligned with approximately 34 to 37 degrees. After marking the stair board 170 with a 4" pencil line 190, insert the L-bar 18 into the base portion 14 so that the L-bar 18 is flush with the bottom surface 76 of the base portion 14. Position the support bracket 16 approximately 9" to 12" from the end of the board allowing room for the step run. Allow the L-bar 18 to ride over the top edge of the board and line the string 20 up with the noted degree and trace along the support bracket 16 and the inch scale 74 making a line 192. Measure the step run along the traced line. This will be the starting point of the step rise. Turn the L-bar 18 around and put the L-bar 18 back into the base portion 14. Wrap the string 20 up and push the hook 130 into the wrapped up string 20 to keep the hook 130 from falling out. Put the rafter tool 10 on the top edge of the board. Line the base portion 14 of the rafter tool 10 with the step run mark and trace a line 194 along the L-bar 18. Turn the rafter tool 10 around and repeat.

Figure 19:
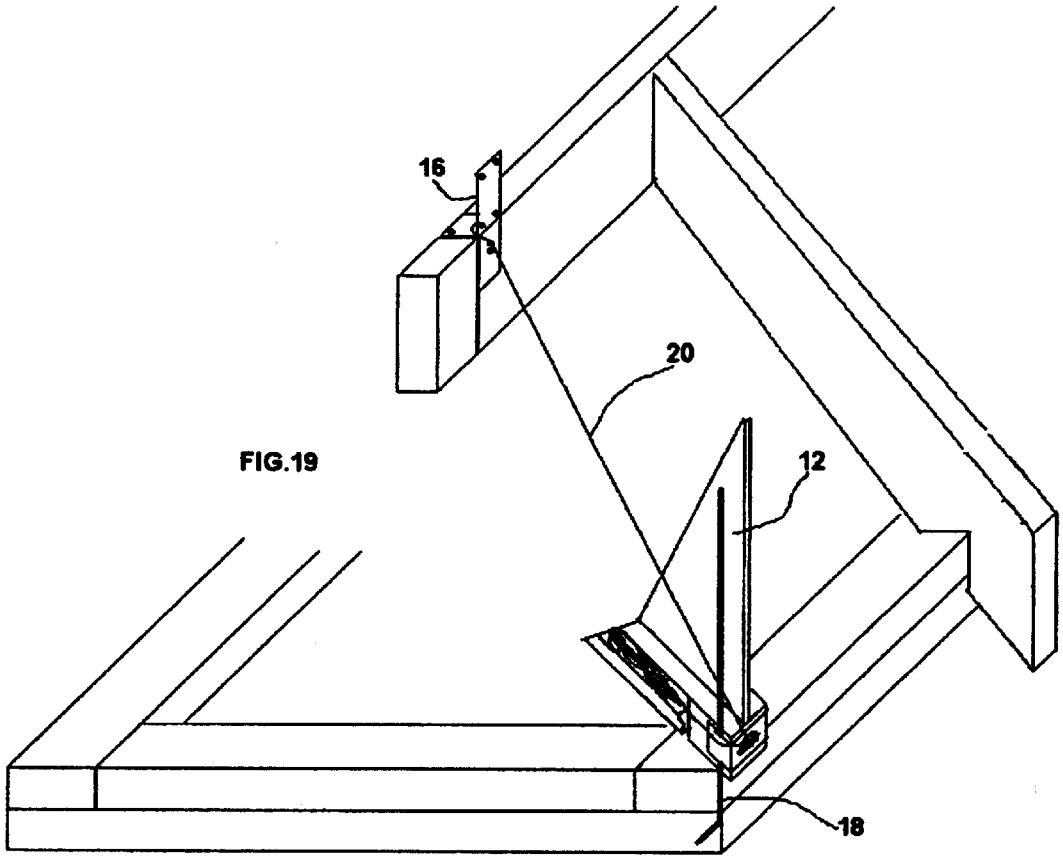
FIG. 19 is a view of the rafter tool positioned on a building for laying out a hip rafter.
Figure 20:
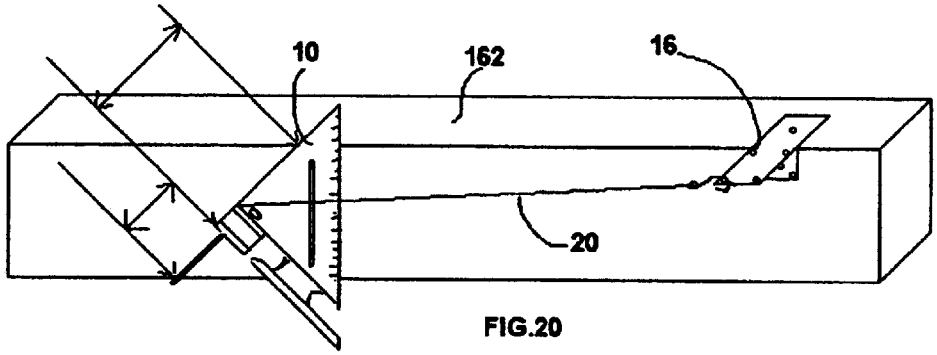
FIG. 20 is a view of the rafter tool positioned on a board for laying out the hip rafter.

Referring to FIGS. 19 and 20, to lay out hip rafters, position a board in line with the ridge and mark a line at the end of the board. This mark will be the starting point. Draw a plumb mark with the square and on the outside corner of the wall trace a 45 degree mark with the pencil from the outside to the inside. Place the support bracket 16 on the plumb mark and the square portion 12 on the outside corner of the wall Secure the string 20 the same way as when laying out the common rafter. Note the degree and set the square portion 12 to the side leaving the support bracket 16 attached to the ridge board.

Measure half the thickness of the rafter board and measure over this distance from the center in both directions and put marks. Connect the outer two most points, trace and cut along mark with a saw. This will allow the hip rafter to seat against the wall. Unwrap the string 20 from the rafter tool 10 and put the string 20 against the outside mark. Wrap the remaining string 20 around the center support 52. Disregard the degree as the string 20 is now being used as a tape measure.

Using the common rafter, measure along the plumb mark from the top to the seat cut. Take the L-bar 18 and extend the L-bar 28 out twice the distance as a common. Lay the board out the same way as a common, but keep the support bracket 16 back a few inches from the end of the rafter board. Using the degree measured previously, trace along the L-bar 18. Set the rafter tool 10 to the side and extend the trace mark to the top edge of the board. Measure down the same distance as previously measured and put a mark. Then, measure down from the mark and set the L-bar 18 at the same distance. Put the rafter tool 10 back on the board and trace. This measurement is what the L-bar 18 should be set at for hips and valleys. Using the square portion 12, trace a 45 degree angle on the board. On the back side of the board, trace the same angle as the heel cut. Put the same on a 45 degree angle and cut.

Figure 21:
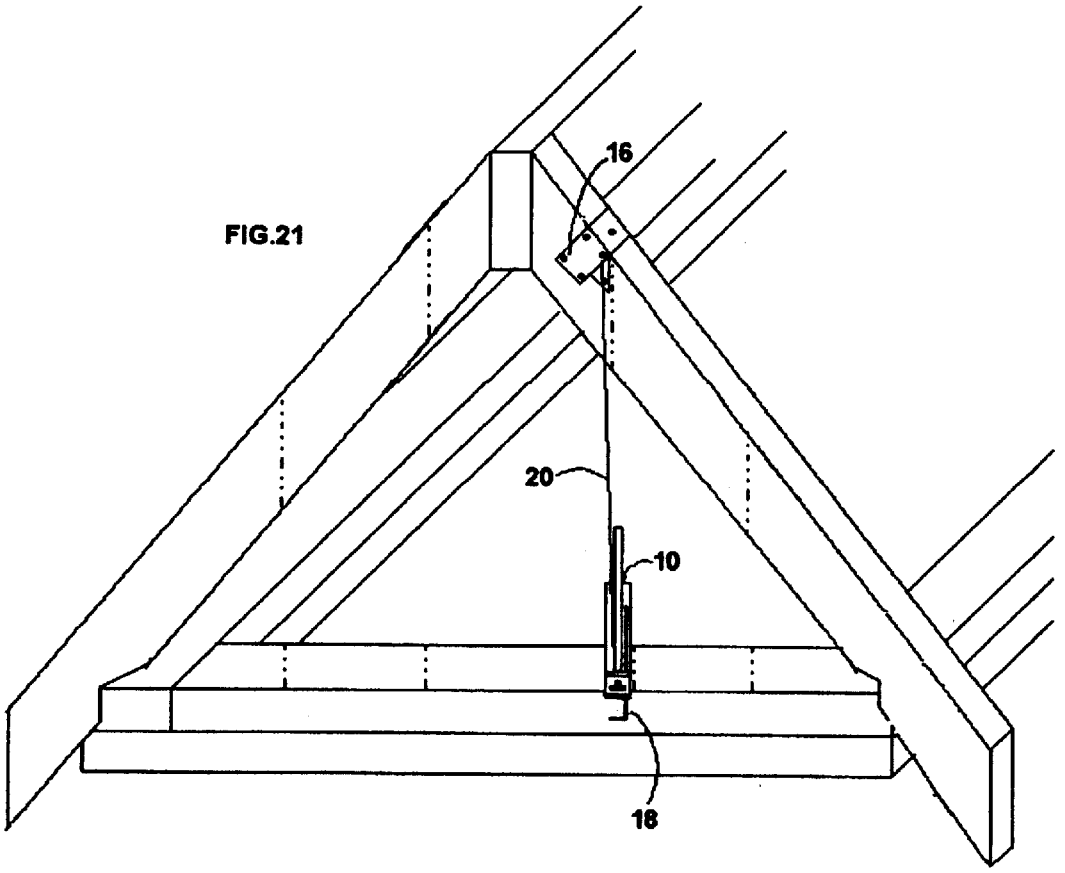
FIG. 21 is a view of the rafter tool positioned on a building for laying out a jack rafter.
Figure 18:
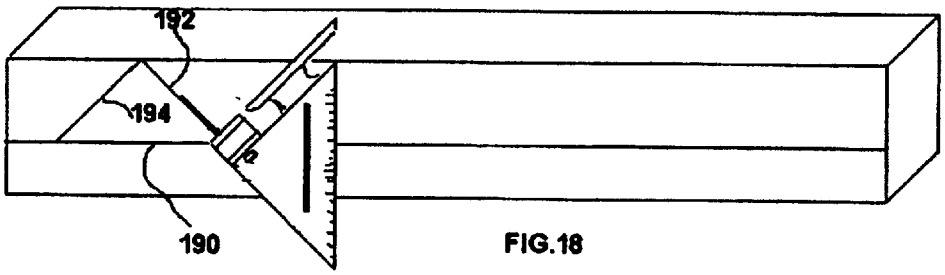
FIG. 18 is a view of the rafter tool positioned in a different position on the board for laying out the stair case.

Referring to FIGS. 21 and 10, to lay out a jack rafter, mark the lines for spacing of the rafters. Put the base portion 14 on the wall plate with the string 20 in line with the marks. Disregard the degree and use the same degree as when laying out a common rafter. Adjust the L-bar 18 the same distance as the common rafter and lay it out the same way. After determining the direction of the angle, put the saw on a 45 degree angle and cut the board.

Alternatively, measure the distance with a tape measure from the top outside edge of the wall to the rafter, keeping in line with the marks. Then, measure the string 20 on the rafter tool 10 the same as the tape measure and secure. Use the same degree as the common rafter.

Figure 22:
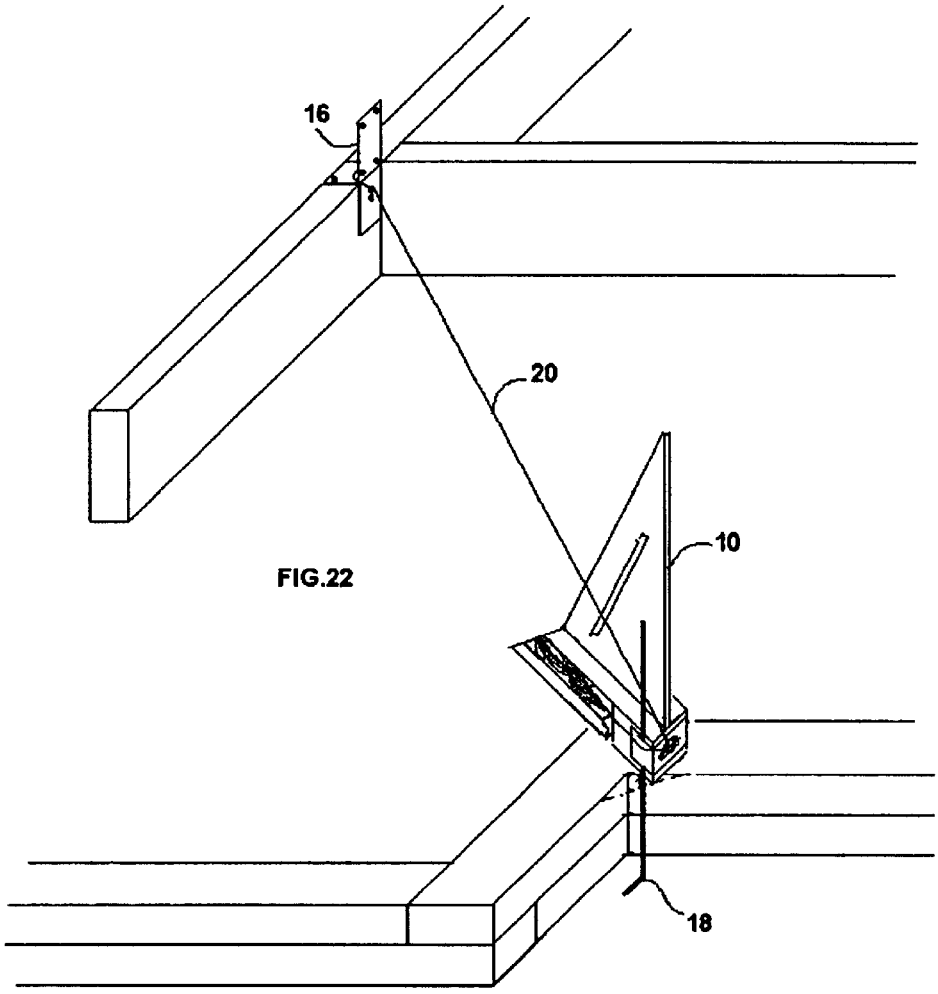
FIG. 22 is a view of the rafter tool positioned on a building for laying out a valley rafter.

Referring to FIGS. 22 and 10, to lay out valley rafters, trace a mark from the outside corner to the inside corner. Then, measure the total thickness of the rafter board and divide the measurement in half. Measure out each way from the center mark. Position the support bracket 16 at the intersection point of the ridge and secure it. Do the same way as a common rafter except put the rafter tool 10 on the outside mark. Hold the L-bar 18 in line with an imaginary line, extending between the previously laid out marks, representing the total length of the valley rafter. Note the degree that the string 20 is aligned with. Continue with the same procedure as laying out hip rafters.

To make a double compound cut, put a mark ½ of the thickness of board on the edge of the board. Make a 45 degree mark back each way from the half way mark. From these points, put the same angle as the heel cut on both sides. Cut both sides on a 45 degree angle with the saw.

As an alternative to laying out the hip and valley rafters, using the run and rise, lay the boards out the same as a common rafter. The seat cut depth will change because the runs are longer. Extend the L-bar 18 out 4 to 5 inches and lay the board out the same as done in the common but only trace along the L-bar 18. Leave the support bracket 16 in place and set the rafter tool 10 to the side. The mark can be used to determine the heel cut depth. Referring back to the common rafter, measure along the plumb mark from the top to the seat cut. Measure down this distance along the plumb mark and put a mark. Measure from the mark down along the plumb line to the edge of the board. This measurement should be used to position the L-bar 18. Adjust the L-bar 18 and lay it out the same as with a common rafter.

Figure 23:
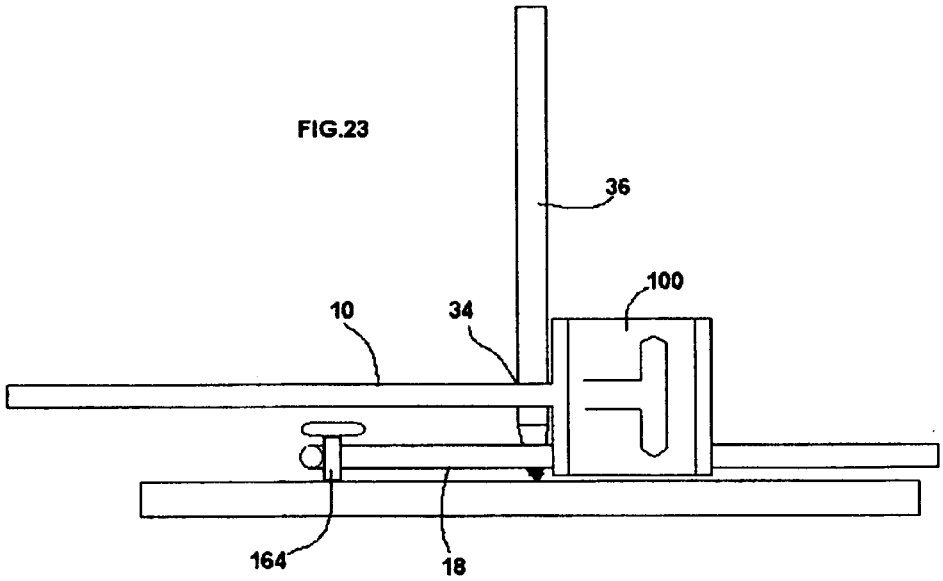
FIG. 23 is a view of the rafter tool positioned on a board for laying out a hole.

Referring to FIG. 23, to make a hole using the rafter tool 10, position the pencil 36 in the hole 34. Position the L-bar 18 on the opposite side of the rafter tool 10 as the pencil 36 having the L-bar 18 extending upwardly. Measure the side of the hole to be cut. Either drill a hole in the wood to put the L-bar 18 into or insert a nail 164 or screw into the wood. Rotate the L-bar 18 either within the hole or about the nail to make the circle.

The rafter tool 10 may also be used to lay out a level or flush cut rafter, which is a type of rafter that does not extend past the wall. Determine the degree by measuring the run and rise as done previously. Place the base portion 14 of the rafter tool 10 on the top edge of the board. The retaining clip 100 that holds the L-bar 18 will catch the top edge of the board. Make a guide, line the string up with the degree and trace. Transfer the same back angle to the front, forming the top plumb cut. Finish tracing the line down to the bottom of the board and cut with a saw.

Figure 24:
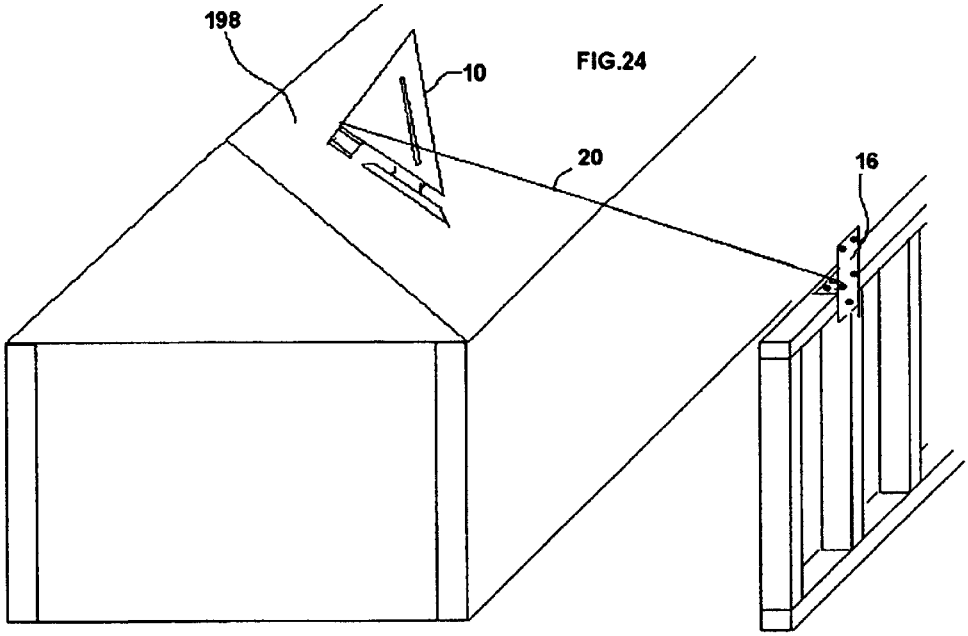
FIG. 24 is a view of the rafter tool positioned on a building for laying out a rafter to an existing roof line.

Referring to FIG. 24, the rafter tool 10 may be used to lay out rafters going to an existing roof line. This type of rafter ties into the existing roof line of the billing. First, determine where the new rafters are to line up on the existing roof 198 as with laying out a ridge. Secure the support bracket 16 to the roof having the support bracket 16 laying flat on the roof. Mark the roof with the pencil 36 where the string 20 is positioned. Lay out the roof boards the same as a common rafter.

Next, put the support bracket 16 on the wall and the square portion 12 on the roof 198 with the L-bar 18 in line with the pencil mark on the roof. Secure the string 20 and note the degree. Lay out the board the same as a common rafter. Cut out the birds mouth. Position the support bracket 16 in the birds mouth cut and hook the string 20 to the support bracket 16. Allowing the L-bar to ride on the top edge of the board, line up the L-bar 18 with the same degree measured from the roof. Trace with the pencil 36 forming the top plumb cut. Cut along the line with the saw.

An advantage of the rafter tool 10 is that all of the components of the rafter tool 10 can be compactly and easily stored together. The L-bar 18, the support bracket 16, the pencil 36 and the string 20 can be secured to the base portion 14 during storage.

Another advantage of the rafter tool 10 is that the rafter boards can be laid out on the ground, on a stud wall, or a surface other than the roof. This eliminates the need for a person to climb up onto the roof for laying out the rafter boards.

Yet another advantage of the rafter tool 10 is that one person can lay out the rafter boards. The use of the support bracket 16 eliminates the need for two people for laying out the rafters.

Yet another advantage is that a square portion 12 and a measuring scale is are integrally attached to the other components of the rafter tool 10 reducing and consolidating the amount of tools required to lay out the rafter boards.

In addition to laying out common rafters, the rafter tool can also be used for laying hip rafters, jack rafters, valley rafters, level or flush rafters, and rafters to existing roof lines. The rafter tool can also be used for making holes by inserting a pencil through the hole 34 in the square portion 12.

Another advantage of the rafter tool is that it can be used for laying out staircases. The components of the rafter tool are used the same as laying out a common rafter and, in addition, the position of the L-bar can be altered for laying out the cuts for the steps.

Thus there has been shown and described a novel rafter tool and method which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A rafter tool, comprising:

a square portion having a first edge, a second edge and a third edge forming a triangular portion, the first edge having a degree scale, the second edge having a measuring scale;

a base portion having an upper support, a lower support, and a center support positioned therebetween, the upper support attached to the third edge of the square portion, the base portion having a first slot positioned parallel to the center support and having at least one second slot positioned perpendicular to the center support and extending through the base portion;

an extension member positionable between the upper and lower supports of the base portion and about the center support of the base portion during storage of the extension member and extendable from the base portion during use of the rafter tool, the extension member alignable with the degree scale of the square portion for providing an angular measurement for a rafter board; and an L-bar positionable within the first slot during storage of the L-bar and positionable within the at least one second slot during use of the rafter tool.

2. The rafter tool according to claim 1, further comprising a support bracket having a first bracket portion, a second bracket portion positioned perpendicular thereto and a plurality of holes therethrough.

3. The rafter tool according to claim 2, further comprising a hook attached to the extension member for engagement with at least one of the plurality holes of the support bracket during use of the support bracket.

4. The rafter tool according to claim 2, wherein the plurality of holes includes at least one hole positioned in the second bracket portion for securing the support bracket to the rafter board.

5. The rafter tool according to claim 2, wherein the plurality of holes includes at least one hole positioned in the first bracket portion for engagement with the L-bar during storage of the support bracket.

6. The rafter tool according to claim 1, wherein the lower support of the base portion further comprises an inch scale for use when measuring distances.

7. The rafter tool according to claim 1, further comprising:

the base portion having a front edge and a rear edge; and a clip having a catch attached to the rear edge of the base portion for enabling the extension member to be wrapped around the catch during laying out of the rafter board.

8. The rafter tool according to claim 1, wherein the base portion has a catch for enabling the extension member to be wrapped around the catch during laying out of the rafter board.

9. The rafter tool according to claim 1, wherein the extension member is a string.

10. The rafter tool according to claim 1, wherein the square portion includes a hole positioned adjacent to the base portion, a pencil insertable through the hole during use of the rafter tool.

11. The rafter tool according to claim 3, wherein the base portion further comprises a first compartment positioned between the upper and lower supports of the base portion for housing the hook and at least a portion of the extension member.

12. The rafter tool according to claim 1, wherein the base portion further comprises a second compartment positioned between the upper and lower supports of the base portion for housing a pencil during storage of the pencil.

13. A rafter tool, comprising:

a square portion having a first edge, a second edge and a third edge forming a triangular portion, the first edge having a degree scale, the second edge having a measuring scale;

a base portion having an upper support, a lower support, the upper support attached to the third edge of the square portion, the base portion having a first end portion, a second end portion and a gap positioned therebetween, the base portion having a first slot positioned parallel to the center support and extending along the lower support, the first end portion having a center support positioned between the upper support and the lower support, and the second end portion having at least one second slot positioned perpendicular to the center support and extending through the base portion;

an extension member positionable about the center support of the base portion during storage of the extension member and extendable from the base portion during use of the rafter tool, the extension member alignable with the degree scale of the square portion for providing an angular measurement for a rafter board;

an L-bar positionable within the first slot during storage of the L-bar and positionable within the at least one second slot during use of the rafter tool; and a support bracket having a first bracket portion and a second bracket portion positioned perpendicular to one another forming a T-shape, one of the first and second bracket portions of the support bracket positionable within the gap between the first and second end portions and the other of the first and second bracket portions positionable extending along the base portion during storage of the support bracket, the support bracket positionable a distance from the square portion and having the extension member attached to the support bracket for laying out rafter boards.

14. The rafter tool according to claim 13, wherein the square portion further includes:

an inch scale positioned at the lower portion of the base portion for use when measuring distances;

a measuring scale positioned along the second edge;

a degree scale positioned along the first edge; and a hip and valley scale positioned parallel to the first edge.

15. The rafter tool according to claim 13, further comprising:

a first compartment positioned between the upper and lower supports of the base portion for housing at least a portion of the extension member; and a second compartment positioned between the upper and lower supports of the base portion for housing a pencil during storage of the pencil.

16. The rafter tool according to claim 13, wherein the support bracket, further includes:

at least one hole positioned in the second bracket portion for engagement with the extension member when laying out rafter boards;

at least one hole positioned in the second bracket portion for securing the support bracket to the rafter board; and at least one hole positioned in the first bracket portion for engagement with the L-bar during storage of the support bracket.

17. A method for laying out boards, comprising the steps of:

measuring a run and measuring a rise;

marking the measured run on a first surface and marking the measured rise on a second surface;

positioning a support bracket in a first position determined by one of the measured run or rise;

positioning the rafter tool in a second position determined by the other of the measured run or rise; extending an extension member from the support bracket to the rafter tool;

reading an angle on the rafter tool which aligns with the extension member;

removing the support bracket and the rafter tool from the first and second positions;

positioning the support bracket on an edge of a board;

adjusting an L-bar attached to the rafter tool to a heel cut depth;

sliding the L-bar along the edge of the board until the extension member lines up with the angle read on the rafter tool;

marking the board along an edge of the rafter tool for laying out a first cut on the board;

measuring a length of a seat cut of the board; and determining the degree of the heel cut and using that same degree for laying out a second cut on the board.

18. The method according to claim 17, further comprising the step of using an inch scale on a base portion of the rafter tool for measuring a desired distance.

19. The method according to claim 17, further comprising the steps of:

laying out a stair case board by positioning the L-bar flush with a lower support of a base portion;

aligning the extension member with a desired angle for providing the first cut;

turning the L-bar around and repositioning the L-bar within a square portion;

positioning the base portion along the first cut and marking the board along the L-bar for providing the second cut; and repeating the first and second cuts for a desired length of the staircase.

20. The method according to claim 17, wherein the step of marking the measured run and rise includes marking the run and rise of a ground surface for laying out the board on a ground surface as compared to on a building.

* * * * *